US009018856B2

(12) United States Patent
Jeong

(10) Patent No.: US 9,018,856 B2
(45) **Date of Patent: *Apr. 28, 2015**

(54) LIGHT EMITTING DIODE DRIVER HAVING PHASE CONTROL MECHANISM

(76) Inventor: Jae Hong Jeong, Saratoga, CA (US)

( * ) Notice: Subject to any disclaimer, the term of this patent is extended or adjusted under 35 U.S.C. 154(b) by 884 days.

This patent is subject to a terminal disclaimer.

(21) Appl. No.: 13/244,900

(22) Filed: Sep. 26, 2011

(65) Prior Publication Data

US 2012/0146524 A1 Jun. 14, 2012

Related U.S. Application Data

(60) Provisional application No. 61/422,128, filed on Dec. 11, 2010.

(51) Int. Cl.
*H05B 37/00* (2006.01)
*H05B 33/08* (2006.01)

(52) U.S. Cl.
CPC ..... *H05B 33/0815* (2013.01); *H05B 33/083* (2013.01); *H05B 33/089* (2013.01)

(58) Field of Classification Search
CPC ..... H05B 33/0815; H05B 33/0833; H05B 33/089
USPC ..... 315/122, 185 R, 186, 192, 193, 200 R, 315/291, 294
See application file for complete search history.

(56) References Cited

U.S. PATENT DOCUMENTS

| | | | | |
|---|---|---|---|---|
| 5,674,762 | A * | 10/1997 | See et al. | 438/234 |
| 6,989,807 | B2 | 1/2006 | Chiang | |
| 7,081,722 | B1 | 7/2006 | Huynh et al. | |
| 7,439,944 | B2 | 10/2008 | Huynh et al. | |
| 8,222,832 | B2 * | 7/2012 | Zheng et al. | 315/291 |
| 2006/0175985 | A1 | 8/2006 | Huynh et al. | |
| 2006/0208669 | A1 | 9/2006 | Huynh et al. | |

(Continued)

FOREIGN PATENT DOCUMENTS

| | | | |
|---|---|---|---|
| JP | 2007-123562 | A | 5/2007 |
| JP | 2007-173813 | A | 7/2007 |
| JP | 2010-225742 | A | 10/2010 |

(Continued)

*Primary Examiner* — Jimmy Vu
*Assistant Examiner* — Amy Yang
(74) *Attorney, Agent, or Firm* — Patent Office of Dr. Chung Park

(57) ABSTRACT

A driver circuit for driving light emitting diodes (LEDs). The driver circuit includes a string of LEDs divided into n groups, the n groups of LEDs being electrically connected to each other in series, a downstream end of group m−1 being electrically connected to the upstream end of group m. The driver circuit also includes a power source coupled to an upstream end of group 1. The driver circuit further includes a plurality of current regulating circuits, where each current regulating circuit is coupled to the downstream end of a corresponding group at one end and coupled to a ground at another end and includes a sensor amplifier and a cascode having two transistors. The driver circuit also includes a phase control logic for sending a signal to each of the current regulating circuits to thereby control a current flow through each of the current regulating circuits.

36 Claims, 15 Drawing Sheets

(56) References Cited

U.S. PATENT DOCUMENTS

| | | | | |
|---|---|---|---|---|
| 2008/0116817 | A1 | 5/2008 | Chao et al. | |
| 2009/0128055 | A1 | 5/2009 | Shin et al. | |
| 2010/0194298 | A1 | 8/2010 | Kuwabara | |
| 2010/0308738 | A1 | 12/2010 | Shteynberg et al. | |
| 2010/0308739 | A1 | 12/2010 | Shteynberg et al. | |
| 2011/0273102 | A1 * | 11/2011 | van de Ven et al. | 315/193 |
| 2012/0081009 | A1 | 4/2012 | Shteynberg et al. | |

FOREIGN PATENT DOCUMENTS

| | | | |
|---|---|---|---|
| KR | 10-2008-0034316 | A | 4/2008 |
| KR | 10-2009-0050381 | A | 5/2009 |
| KR | 10-0905844 | B1 | 7/2009 |
| KR | 10-2010-0067468 | A | 6/2010 |
| KR | 10-0973014 | B1 | 7/2010 |
| KR | 10-0997050 | B1 | 11/2010 |
| WO | 2012-034102 | A1 | 3/2012 |
| WO | 2012-061999 | A1 | 5/2012 |

* cited by examiner

LIGHT EMITTING DIODE DRIVER HAVING PHASE CONTROL MECHANISM

CROSS REFERENCES TO RELATED APPLICTIONS

This application claims the benefit of U.S. Provisional Applications No. 61/422,128, filed on Dec. 11, 2010, entitled "Light emitting diode driver using turn-on voltage of light emitting diode," and relates U.S. application, Ser. No. 13/244,892, filed on Sep. 26, 2011, entitled "Light emitting diode driver," issued as U.S. Pat. No. 8,890,432, and U.S. application, Ser. No. 13/244,873, filed on Sep. 26, 2011, entitled "Light emitting diode driver having cascode structure," which are hereby incorporated by reference in their entirety.

BACKGROUND OF THE INVENTION

The present invention relates to a light emitting diode (LED) driver, and more particularly, to a circuit for driving a string of light emitting diode (LEDs).

Due to the concept of low energy consumption, LED lamps are prevailing and considered a practice for lighting in the era of energy shortage. Typically, an LED lamp includes a string of LEDs to provide the needed light output. The string of LEDs can be arranged either in parallel or in series or a combination of both. Regardless of the arrangement type, providing correct voltage and/or current is essential to efficient operation of the LEDs.

In application where the power source is periodic, the LED driver should be able to convert the time varying voltage to the correct voltage and/or current level. Typically, the voltage conversion is performed by circuitry commonly known as AC/DC converters. These converters, which employ an inductor or transformer, capacitor, and/or other components, are large in size and have short life, which results in an undesirable form factor in lamp design, high manufacturing cost, and reduction in system reliability. Accordingly, there is a need for an LED driver that is reliable and has a small form factor to thereby reduce the manufacturing cost.

SUMMARY OF THE INVENTION

In one embodiment of the present disclosure, a method for driving light emitting diodes (LEDs) includes: providing a string of LEDs divided into groups, the groups being electrically connected to each other in series; providing a power source electrically connected to the string of LEDs; coupling each of the groups to a ground through a corresponding one of current regulating circuits; measuring a phase of a voltage waveform of the power source; and turning on the groups in a downstream sequence based on the measure phase.

In another embodiment of the present disclosure, a driver circuit for driving light emitting diodes (LEDs) includes: a string of LEDs divided into n groups, the n groups of LEDs being electrically connected to each other in series, a downstream end of group m−1 being electrically connected to the upstream end of group m, where m being a positive number equal to or less than n; a power source coupled to an upstream end of group 1 and operative to provide an input voltage; a plurality of current regulating circuits, each of the current regulating circuits being coupled to the downstream end of a corresponding group at one end and coupled to a ground at another end and including a sensor amplifier and a cascode having first and second transistors; and a phase control logic for sending a signal to each of the current regulating circuits to thereby control a current flow through each of the current regulating circuits.

These and other features, aspects and advantages of the present invention will become better understood with reference to the following drawings, description and claims.

DETAILED DESCRIPTION OF THE INVENTION

Figure 1:
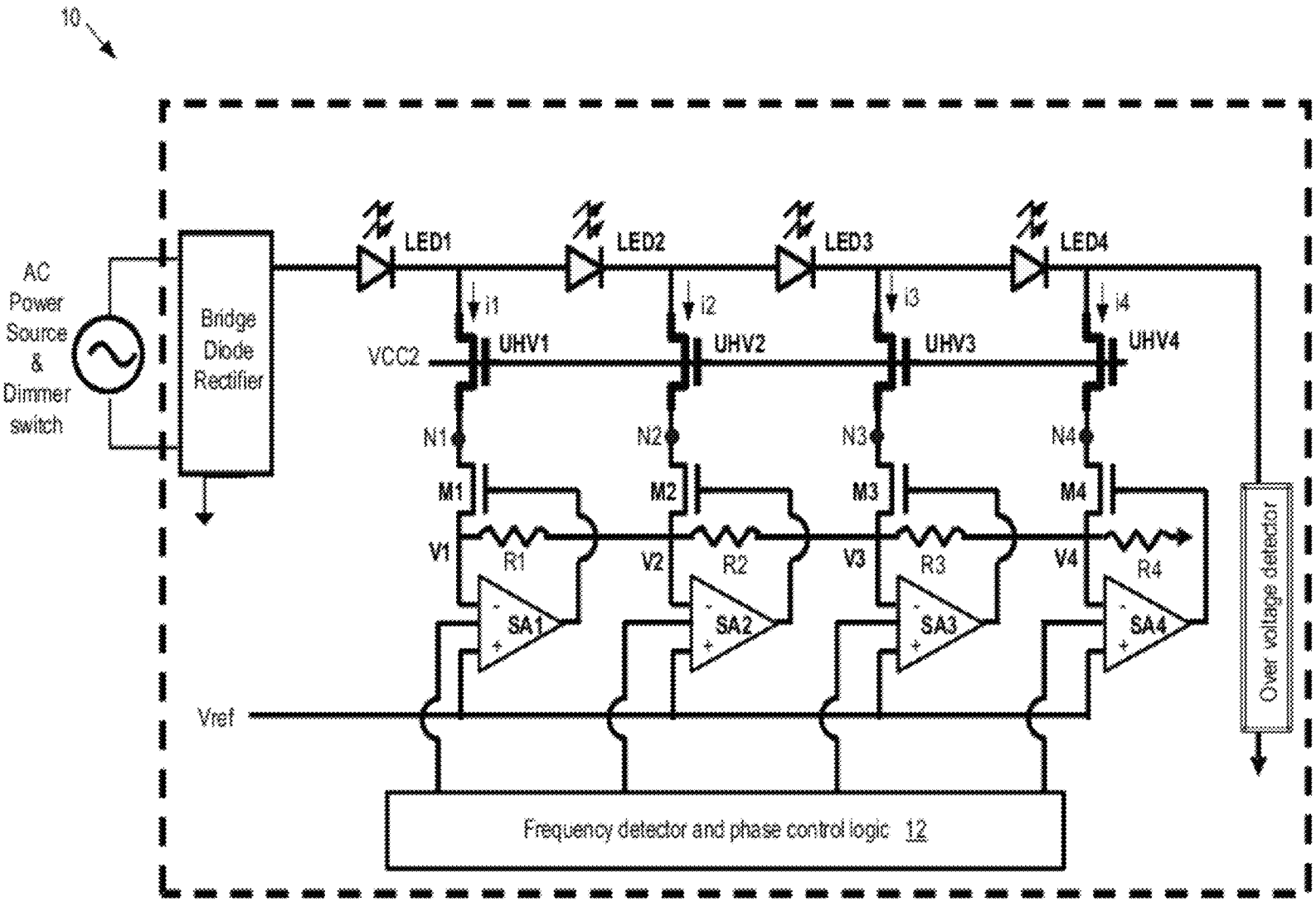
FIG. 1 shows a schematic diagram of an LED driver circuit in accordance with one embodiment of the present invention.

Referring now to FIG. 1, there is shown a schematic diagram of an LED driver circuit (or, shortly driver) 10 in accordance with one embodiment of the present invention. As depicted, the driver 10 is powered by a power source such as an alternative current (AC) power source. The electrical current from the AC power source is rectified by a rectifier circuit. The rectifier circuit can be any suitable rectifier circuit, such as bridge diode rectifier, capable of rectifying the alternating power from the AC power source. The rectified voltage, Vrect, is then applied to a string of light emitting diodes (LEDs). If desirable, the AC power source and the rectifier may be replaced by a direct current (DC) power source. Optionally, a dimmer switch may be installed to adjust the intensity of the light generated by LEDs. Hereinafter, the term "AC power source & dimmer switch" refers to AC power source or AC power source connected to a dimmer switch.

The LEDs as used herein is the general term for many different kinds of light emitting diodes, such as traditional LED, super-bright LED, high brightness LED, organic LED, etc. The drivers of the present invention are applicable to all kinds of LED.

As depicted in FIG. 1, a string of LEDs is electrically connected to the power source and divided into four groups. However, it should be apparent to those of ordinary skill in the art that the string of LEDs may be divided into any suitable number of groups. The LEDs in each group may be a combination of the same or different kind, such as different color. They can be connected in serial or parallel or a mixture of both. Also, one or more resistances may be included in each group.

A separate current regulating circuit (or, shortly regulating circuit) is connected to the downstream end of each LED group, where the current regulating circuit collectively refers to a group of elements for regulating the current flow, say i1, and includes a first transistor (say, UHV1), a second transistor (say, M1), and a sensor amplifier (say, SA1). Hereinafter, the term transistor refers to an N-Channel MOSFET, a P-Channel MOSFET, an NPN-bipolar transistor, a PNP-bipolar transistor, an Insulated gate Bipolar Transistor (IGBT), analog switch, or a relay.

The first and second transistors are electrically connected in series, forming a cascode structure. The first transistor is capable of shielding the second transistor from high voltages. As such, the first transistor is referred as shielding transistor hereinafter, even though its function is not limited to shielding the second transistor. The main function of the second transistor includes regulating the current i1, and as such, the second transistor is referred as regulating transistor hereinafter. The shielding transistor may be an ultra-high-voltage (UHV) transistor that has a high breakdown voltage of 500 V, for instance, while the regulating transistor M1 may be a low-voltage (LV), medium-voltage (MV), or a high-voltage (HV) transistor and has a lower breakdown voltage than the shielding transistor. The node, such as N1, refers to the point where the source of the shielding transistor is connected to the drain of the regulating transistor.

The sensor amplifier SA1, which may be an operational amplifier, compares the voltage V1 with the reference voltage Vref, and outputs a signal that is input to the gate of the regulating transistor, to thereby form a feedback control of the current i1 flowing through the cascode and the current sensing resistors R1, R2, R3, and R4. The gate voltage of the shielding transistor may be set to a constant voltage, Vcc2. (Hereinafter, Vcc2 refers to a constant voltage.) The mechanism for generating the constant gate voltage Vcc2 is well known in the art, and as such, the detailed description of the mechanism is not described in the present document.

As discussed above, each current regulating circuit is electrically connected to the downstream end of the corresponding LED group at one end and to the ground at the other end via the current sensing resistors. The voltages V1, V2, V3, and V4 represent the electrical potentials at the downstream ends of the regulating transistors M1, M2, M3, and M4, respectively. Thus, for instance, the voltage V1 can be represented by the equation:

$$V1=i1*(R1+R2+R3+R4)+i2*(R2+R3+R4)+i3*(R3+R4)+i4*R4.$$

The driver 10 can turn on/off each group of LEDs successively according to the signals received from the frequency-detector and phase-control-logic (or, shortly, phase-control-logic) 12. For example, the phase-control-logic 12 sends a signal to the sensor amplifier SA1 to turn on the regulating transistor M1, while the other regulating transistors M2-M4 are turned off. As will be discussed on conjunction with FIGS. 4A-4F, the phase-control-logic 12 may send output signals to the sensor amplifiers SA1-SA4 to control the regulating transistors M1-M4 in various time sequences.

In another example, the phase-control-logic 12 sends signals to more than one sensor amplifiers, say SA1 and SA2, to turn on more than one regulating transistors, say M1 and M2. As Vrect increases from the ground level, the current flows only through the first LED group, i.e., only the current i1 flows. As Vrect further increases enough to turn on the first and second LED groups, LED1 and LED2 (or Group 1 and Group 2), the current i2 starts flowing through the second current regulating circuit. At the same time, V1 further increases and exceeds Vref at a point in time. At this point, the feedback loop control mechanism cuts off the current i1, i.e., the sensor amplifier SA1 compares the voltage level V1 with the reference voltage Vref and sends a control signal to the regulating transistor, M1. More specifically, when V1 is higher than Vref, the sensor amplifier SA1 sends a low-state output signal to the regulating transistor M1 to thereby turn off the regulating transistor M1.

In another example, the sensor amplifier SA1 controls the regulating transistor M1 based on the output signals of the phase-control-logic 12 only. Detailed description of the current regulating methods is given in conjunction with FIGS. 4A-4F.

The same analogy applies to other current regulating circuits corresponding to Groups 2-4. For example, the current i3 is controlled by the sensor amplifier SA3 based on either the output signal of the phase-control-logic 12 or V3 or both. When the source voltage (or the rectified voltage Vrect) reaches its peak and Vrect starts descending, the above process reverses so that the first current regulating circuit turns back on last.

As discussed above, each regulating circuit includes two transistors, such as UHV1 and M1, arranged in series to form a cascode structure. The cascode structure, which is implemented as a current sink, has various advantages compared to a single transistor current sink. First, it has enhanced current driving capability. When operating in its saturation region, which is desired for a current sink, the current driving capability (Idrv) of an LV/MV/HV NMOS is far superior to an UHV NMOS. For example, Idrv of a typical LV NMOS is 500 μA/μm whereas that of a typical UHV NMOS is 10~20 μA/μm. Thus, to regulate the same amount of current flow, the required projection area of an UHV NMOS on the chip is at least 20 times as large as that of an LV NMOS. Also, a typical UHV NMOS has the minimum channel length of 20 μm, while a typical LV NMOS has the minimum channel length of 0.5 μm. However, a typical LV NMOS requires a shielding mechanism that offers protection from high voltages. In the cascode structure, the first transistor, preferably UHV NMOS, operates as a shielding transistor, while the second transistor, preferably LV/MV/HV NMOS, operates as a current regulator, providing enhanced current driving capability. The shielding transistor is not operating in saturation region as would be in the case where a single UHV NMOS is used as the current sink and operated in the linear region. As such, the current driving capability Idrv is not the determinative design factor; rather the resistance of the shielding transistor, Rdson, is the important factor in designing the UHV NMOS of the cascode.

Second, due to the series configuration of the cascode structure, the required voltage (a.k.a. voltage compliance or voltage headroom) of the cascode structure can be higher than a single UHV NMOS configuration. For an LED driver case, however, the power loss due to the required voltage is much less than the power loss due to the LED driving voltage. For example, in an AC-driven LED driver case, the LED driving voltage (voltage on the LED anode) ranges 100 Vmrs~250 Vrms. Assume the required voltage of a single UHV NMOS is 2V whereas that of a cascode structure is 5V. In this case, the efficiencies are 98~99% and 95~98%, respectively. Of course, Rdson can be reduced so that the required voltage of the cascode structure can be about the same as that of a single UHV NMOS. The point is that the additional power consumed by the cascode structure is a minor disadvantage. If efficiency is a crucial design factor, the cascode structure can be designed in a current mirror configuration whereas a current mirror configuration using two UHV NMOS transistors is not practically feasible due to their large area on the chip.

Third, turning on/off the current sink is easier in the cascode structure since the UHV MOS and LV/MV/HV NMOS are controlled separately. In a single UHV NMOS current sink, both current regulation and on/off action have to be done by controlling the gate of the UHV NMOS, which has the characteristics of a large capacitor. In contrast, in the cascode structure, the current regulation can be done by controlling the LV/MV/HV NMOS and on/off action can be done by controlling the UHV NMOS that requires only logic operation applied on the gate.

Fourth, the speed of turning on/off is controlled more smoothly in the cascode structure than a single UHV NMOS configuration. In a single UHV NMOS configuration, the linear control of current cannot be easily achieved by controlling the gate voltage since the current is a square function of the gate voltage. By contrast, in a cascode structure, when the gate of the LV/MV/HV NMOS is controlled, the current control (slewing) becomes smoother since it is operating as a resistor that is an inverse function of the gate voltage.

Fifth, the cascode structure provides better noise immunity. Noise from the power supply can propagate through the LEDs and subsequently can be coupled to the current regulating circuit. More specifically, the noise is introduced into the feedback loop of the current regulating circuit. In a single UHV NMOS configuration, this noise is directly coupled to this loop, whereas, in a cascode structure, the noise is attenuated by the ratio of Rdson of the UHV NMOS to the effective resistance of the LV/MV/HV NMOS.

Sixth, the noise generated by a cascode structure is lower than a single UHV NMOS configuration. In the cascode structure, the current control is mainly performed by the regulating transistor, while, in a single UHV NMOS configuration, the current control is performed by the UHV NMOS. Since the gate capacitance of the LV/MV/HV NMOS is lower than the UHV NMOS, the noise generated by the cascode structure is lower than a single UHV NMOS configuration.

It is noted that the shielding transistors UHV1~UHV4 may be identical or different from each other. Likewise, the regulating transistors M1~M4 may be identical or different from each other. The specifications of the shielding and regulating transistors may be selected to meet the designer's objectives.

Figure 2A:
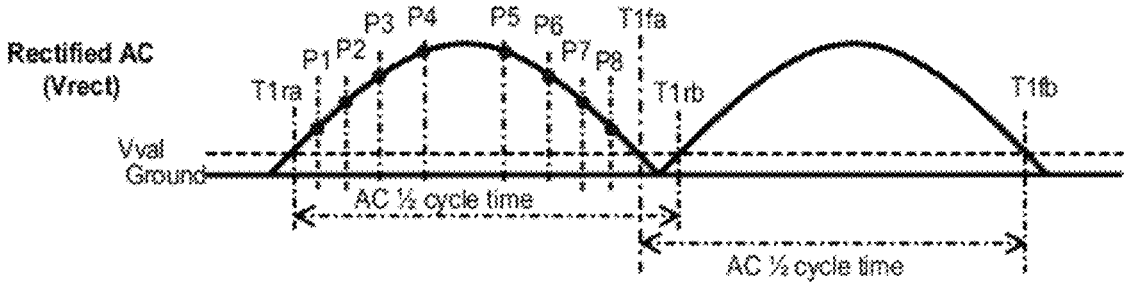
FIGS. 2A-2C show various waveforms of the rectified voltage that might be input to the driver of FIG. 1.

As discussed above, the phase-control-logic 12 sends signals to the sensor amplifiers SA1~SA4. The operation of the phase-control-logic 12 includes measuring the AC ½ cycle time, where the AC ½ cycle time refers to half the cycle period of AC signal. FIG. 2A shows the waveform of a rectified voltage input to the driver 10 as a function of time, where the AC ½ cycle time is the time interval between T1*ra* and T1*rb* or between T1*fa* and T1*fb*. FIG. 2D shows a schematic diagram of the phase-control-logic 12 of FIG. 1. As depicted in FIG. 2D, the detector 13 monitors the voltage level of Vrect and sends a signal, enable 1, when Vrect rises to a preset level, such as Vval. For instance, the detector 13 sends the first enable signal at T1*ra*. Then, the clock counter 14 starts counting the clock signals received from the oscillator 16. As Vrect rises to the Vval at T1*rb*, the detector 13 sends the second enable signal to the clock counter 14 and the clock counter 14 stops counting the clock signals. Subsequently, the measure counter value is transferred (or, loaded) to the frequency selector 15 to determine the frequency of AC input (or, Vrect). Upon transferring the measured counter value, the clock counter 14 resets the counter value and starts counting again to keep monitoring of rectified AC voltage frequency.

Based on the determined frequency, the frequency selector 15 chooses preset time intervals for the switch tabs (or, shortly, tabs). The driver 10 (shown in FIG. 1) include four tabs that correspond to the input pins of the sensor amplifiers SA1-SA4, and the frequency selector 15 assigns a preset time interval to each tab, where the preset time interval refers to the time interval between a reference point (such as T1*ra*) and the time when a signal is to be sent to the corresponding tab (such as P1 in FIG. 2A).

The detector 17 monitors the level of descending (or rising) Vrect and sends an enable signal, enable 2, when Vrect falls (or rises) to a predetermined voltage level, such as Vval. Then, the clock counter 18 starts counting the clock signal generated by the oscillator 16. Subsequently, the tab selector 19 receives the count from the clock counter 18. Then, the tab selector 19 compares the count received from the clock counter 18 to the preset time interval received from the frequency selector 15, and sends a switch enabling signal to the corresponding one of the tabs 20 when the count of the clock counter 18 matches the preset time interval. Upon receiving the switch enabling signal from tab selector 19, the corresponding tab, such as the sensor amplifier SA1, turns on/off the regulating transistor M1.

In FIG. 1, there are four sensor amplifiers and thus, eight preset time intervals (i.e., the time intervals between T1*ra* and P1, T1*ra* and P2, T1*ra* and P3, T1*ra* and P4, T1*ra* and P5, T1*ra* and P6, T1*ra* and P7, and T1*ra* and P8, as shown in FIG. 2A) are assigned to the corresponding sensor amplifiers by the frequency selector 15. Since each of the preset time intervals corresponds to a fixed phase point of the input voltage waveform, each of the preset time intervals also refers to a phase difference between the reference phase at T1*ra* and the phase at the corresponding point, such as P1. As such, the terms "preset time interval" and "preset phase difference" are used interchangeably.

It is noted that the detector 13 may send the enable signal when Vrect rises or falls to Vval. For example, the detector 13 may send the enable signal at T1*fa* and T1*fb* (or, T1*ra* and T1*rb*) so that the clock counter 14 can count the clock signals during one AC ½ cycle time. Likewise, the detector 17 may send the enable signal when Vrect rises or falls to Vval. It is also noted that the detectors 13 and 17 may send enable signals at different preset voltage levels.

A digital locked loop or a phase locked loop may be used in place of the clock counter 14 (or, clock counter 18). As the DLL, PLL, and clock counter are well known in the art, the detailed description is not given in the present document.

Figure 2B:
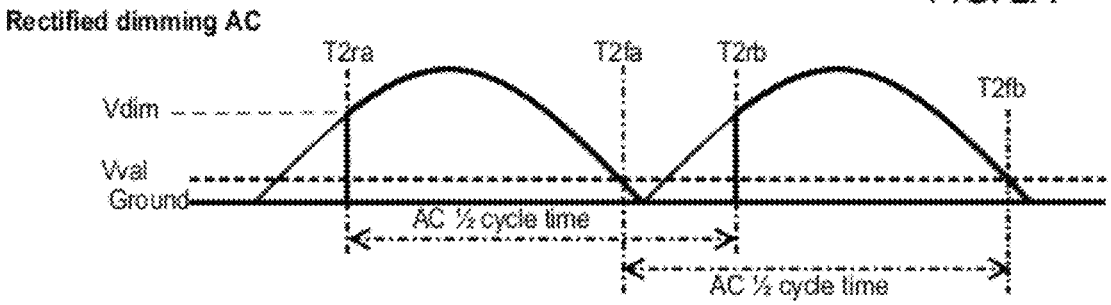
Figure 2C:
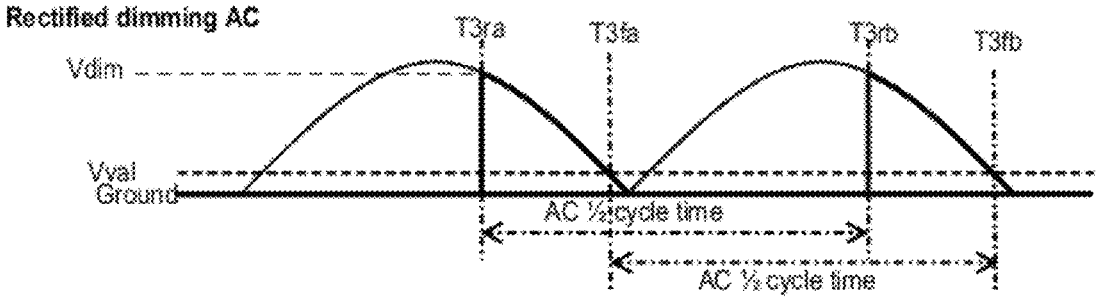
Figure 2D:
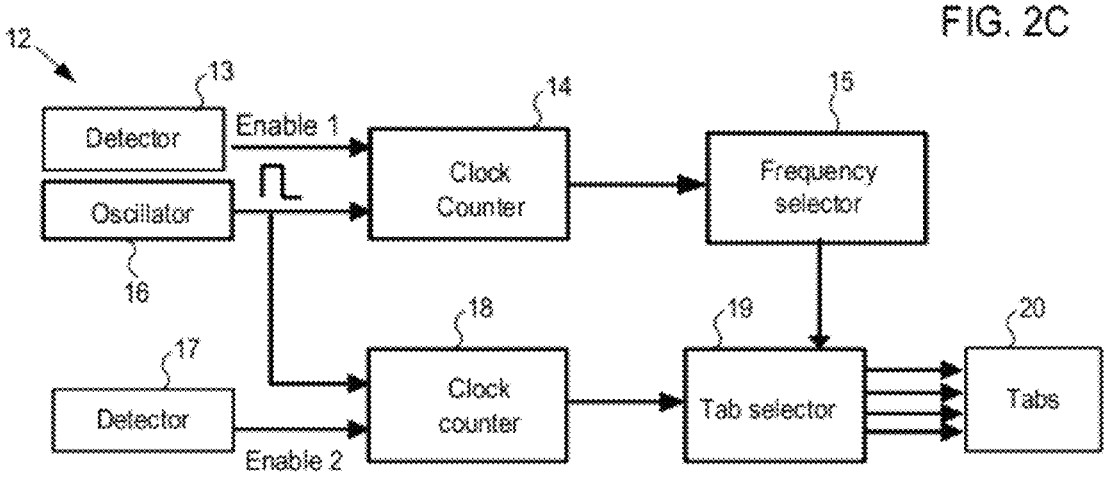
FIG. 2D shows a schematic diagram of the frequency detector and phase control logic of FIG. 1.

FIGS. 2B and 2C show various waveforms of the rectified voltage input to the driver 10 of FIG. 1, where the AC input voltage is processed by dimmer switches. As depicted, the dimmer switch maintains the AC input voltage to the ground level until the AC input voltage rises to Vdim (FIG. 2B) or falls to Vdim (FIG. 2C). The phase-control-logic 12 may measure AC ½ cycle time by counting the clock signal between T2*ra* and T2*rb* or between T2*fa* and T2*fb*. More specifically, the detectors 13 and 17 may send enable signals at one of the points in time, T2*ra*, T2*rb*, T2*fa*, and T2*fb*. The same analogy applies to Vrect in FIG. 2C, i.e., the detectors 13 and 17 may send enable signals at one of the points in time, T3*ra*, T3*rb*, T3*fa*, and T3*fb*.

As described above, the phase-control-logic 12 controls the currents i1-i4 based on the frequency and phase of the AC input voltage waveform. This approach is useful when the noise level of the AC power source is high and/or it is preferable to make the current waveform smoothly follow the AC input voltage waveform. If the current i1 is controlled by the feedback control mechanism only, the current i1 will fluctuate significantly when the noise level of Vrect is high since the feedback control mechanism relies on the level of Vrect. The fluctuation of current flows i1-i4 may result in the luminance flicker that can be perceived by human eyes.

Figure 3A:
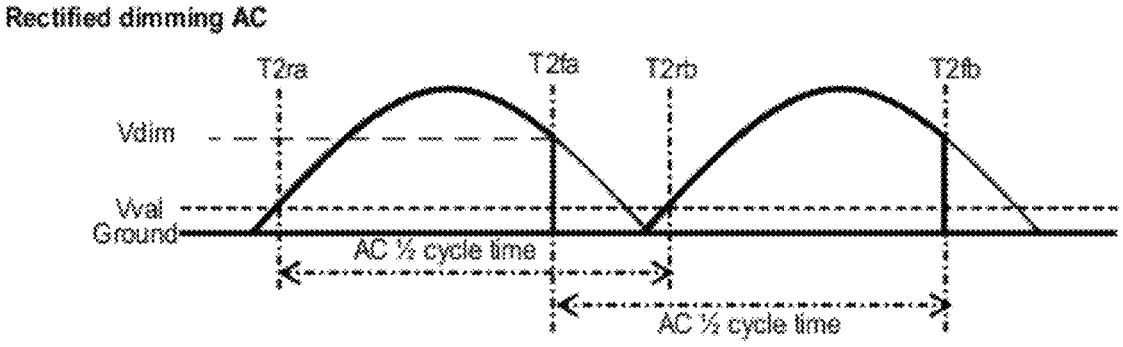
FIGS. 3A-3B show various waveforms of the rectified voltage that might be input to the driver of FIG. 1.
Figure 3B:
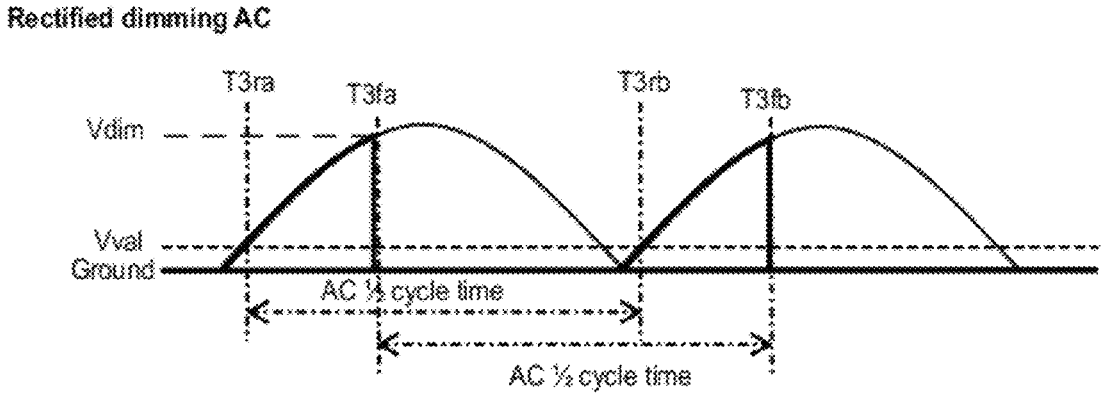

FIGS. 3A and 3B show two waveforms of the rectified voltage that might be input to the driver 10 of FIG. 1. Unlike the dimmers used to generate the waveforms in FIGS. 2B and 2C, the dimmers used to generate the waveforms in FIGS. 3A and 3B cuts off the rear portion of each cycle, i.e., Vrect is maintained at the ground level after Vrect rises/falls to Vdim. As the phase-control-logic 12 measures the frequency and phase in the same manner as described in conjunction with FIGS. 2B and 2C, the detailed description of the operational procedures of the phase-control-logic 12 is not repeated for brevity.

Figure 4A:
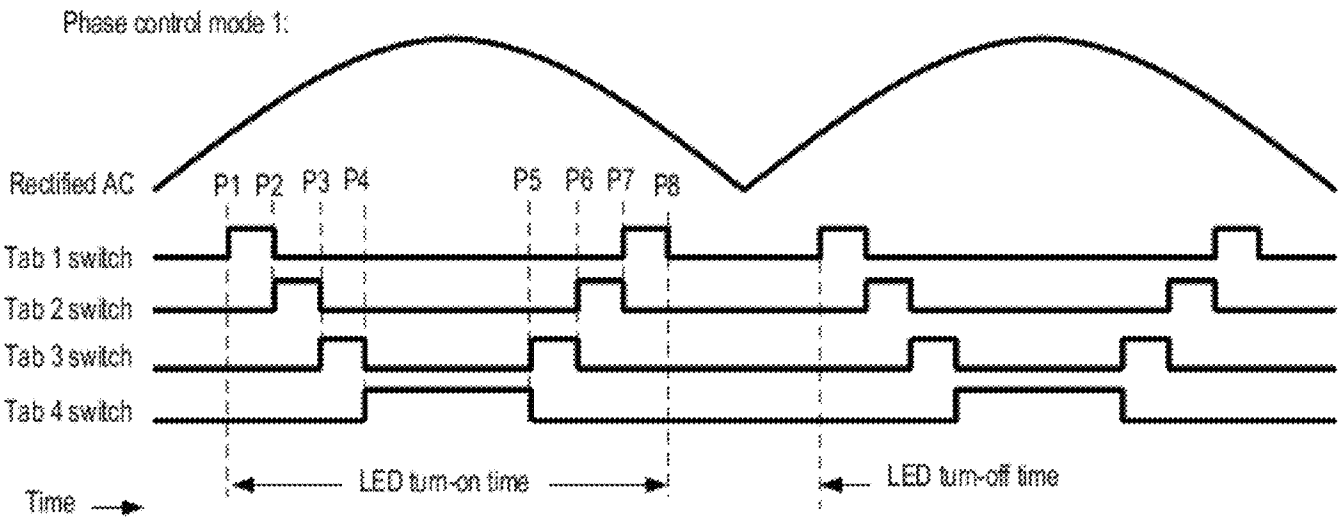
FIGS. 4A-4F show output signals of the frequency detector and phase control logic of FIG. 1.

FIG. 4A shows output signals of the phase-control-logic 12 of FIG. 1, where the four tab switches (or, shortly tabs) correspond to the four sensor amplifiers SA1-SA4. More specifically, each tab switch signal, say tab 1 switch signal, is sent to the corresponding sensor amplifier, say SA1, so that the sensor amplifier turns on/off the corresponding regulating transistor, say M1. As depicted in FIG. 4A, the hat-shaped portions of each tab switch signal waveform represent the time intervals when the corresponding sensor amplifier is turned on, i.e., the tab switch signal is in the active state. As such, the signals sent to the sensor amplifiers are sequenced in time so that only one of the regulating transistors M1-M4 is turned on at each point in time. More specifically, turn-on and turn-off signals are sent by the phase-control-logic 12 to SA1 at P1 and P2, respectively. (Here, P1-P8 of FIG. 4A correspond to P1-P8 of FIG. 2A, respectively.) Likewise, SA2, SA3, and SA4 are turned on/off by signals at P2/P3, P3/P4, and P4/P5, respectively. When the Vrect decreases from its peak, SA3, SA2, and SA1 are turned on/off by signals sent at P5/P6, P6/P7, and P7/P8, respectively. As such, only one sensor amplifier is turned on (i.e., in the active state) at each point in time. It is noted that each sensor amplifier, say SA1, continuously compares the source voltage, say V1, of the corresponding regulating transistor, say M1, with Vref and regulates the current flow so that the V1 remains same as Vref when the sensor amplifier is in active state.

Figure 4B:
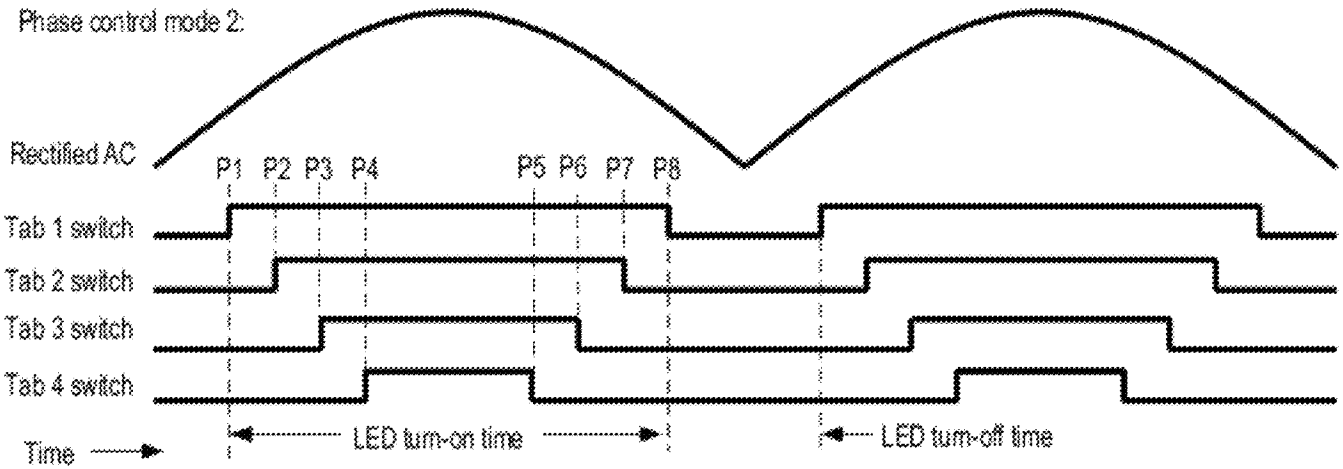

FIG. 4B shows output signals of the phase-control-logic 12 of FIG. 1 according to another embodiment. Unlike the signal waveforms in FIG. 4A, the tab switch signals sent to the sensor amplifiers are sequenced in time so that one or more regulating transistors are turned on simultaneously. For instance, the regulating transistor M1 is turned on/off by the signals at P1/P8, while the regulating transistor M2 is turned on/off by the signals at P2/P7. Thus, the regulating transistor M2 connected to the tab 2 switch is turned on while the regulating transistor M1 connected to the tab 1 switch has been already turned on. It is noted that sensor amplifier SA1 may further control the regulating transistor M1 by use of the feedback loop, as discussed in conjunction with FIG. 1. Thus, it is possible that only one of the regulating transistors M1-M4 may be turned on, even though all of the tab switch signals sent by phase-control-logic 12 are in the active state.

In one example, the phase-control-logic 12 sends a signal to SA1 to turn on M1 at P1. At P1, the current may flow only through the first LED group, i.e., only the current i1 flows. At P2, a signal is sent to SA2 to turn on M2. As Vrect further increases enough to turn on the first and second LED groups, LED1 and LED2 (or Group 1 and Group 2), the current i2 starts flowing through the second current regulating circuit. At the same time, V1 further increases and exceeds Vref at a point in time. At this point, the feedback loop control mechanism cuts off the current i1, i.e., the sensor amplifier SA1 compares the voltage level V1 with the reference voltage Vref and sends a control signal to the regulating transistor, M1. More specifically, when the voltage V1 is higher than Vref, the sensor amplifier SA1 sends a low-state output signal to the regulating transistor M1 to thereby turn off the regulating transistor M1.

Figure 4C:
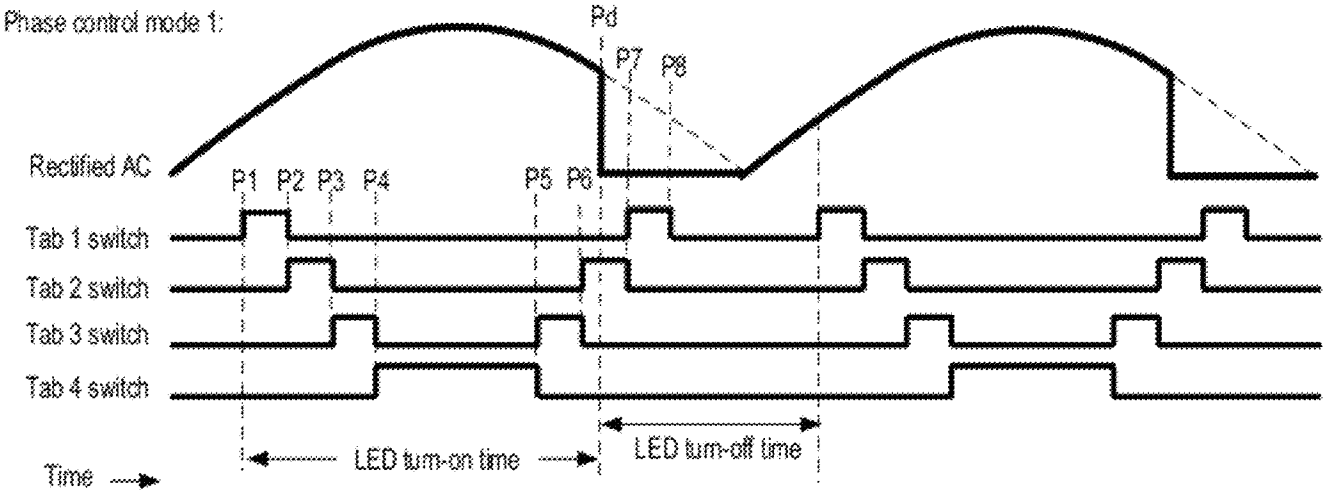
Figure 4D:
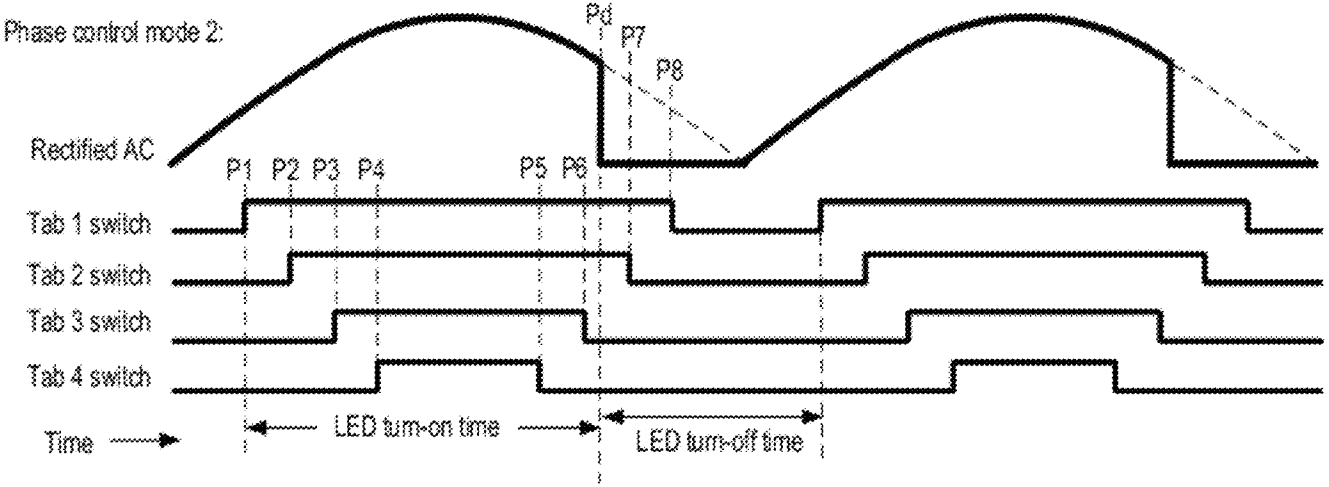

FIGS. 4C and 4D show output signals of the phase-control-logic 12 of FIG. 1 according to another embodiment. As depicted, the waveform of Vrect is similar to Vrect in FIG. 3A, i.e., a dimmer is used to generate the waveform in FIGS. 4C and 4D. The timing sequences in FIGS. 4C and 4D are similar to those in FIGS. 4A and 4B, respectively, i.e., only one sensor amplifier is turned on at each point in time (FIG. 4C), or more than one sensor amplifier may be turned on at each point in time (FIG. 4D). It is noted that, in FIG. 4C, Tab 2 switch, such as SA2, may be in the active state at Pd. However, as Vrect drops to the ground level at Pd, the current flowing through the second current regulating circuit will also drop to zero at Pd. Also, there will be no current flowing through the LED groups between P7 and P8, even though SA1 is in the active state. As such, the total light emitted by the LED groups will be diminished as intended by the dimmer designer. Likewise, as depicted in FIG. 4D, both Tab 1 switch and Tab 2 switch are in the active state at Pd. However, as Vrect drops to the ground level at Pd, the current flowing through the LED groups will also drop to zero, to thereby reducing the total light emitted by the LED groups.

Figure 4E:
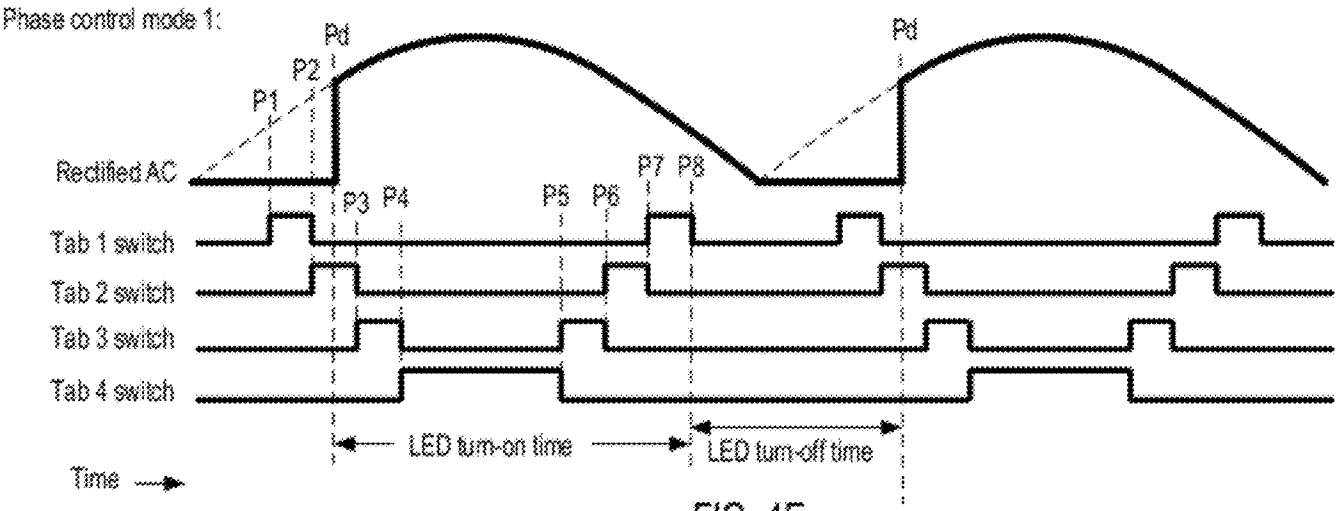
Figure 4F:
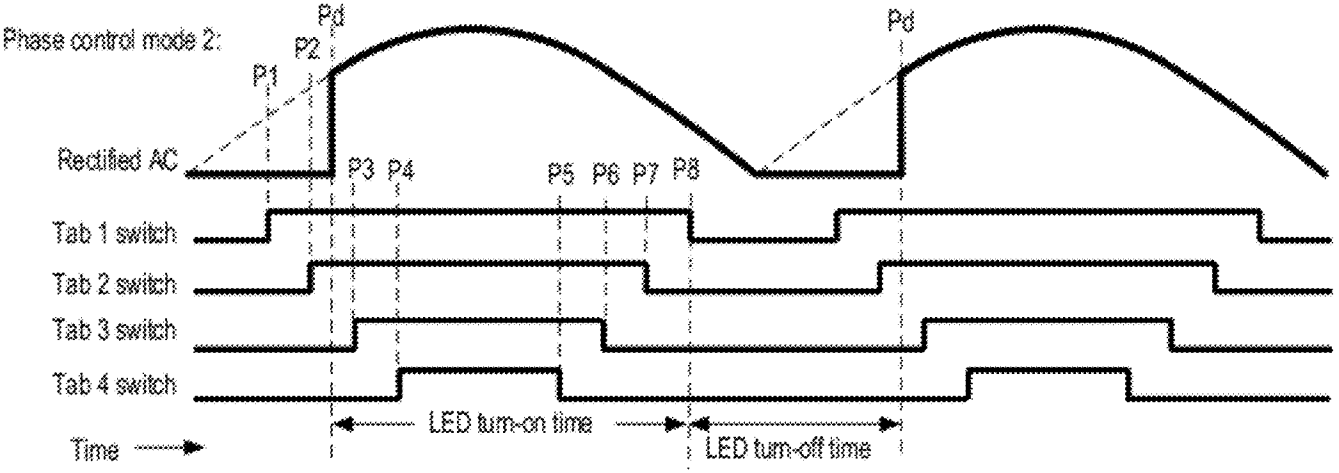

FIGS. 4E and 4F show output signals of the phase-control-logic 12 of FIG. 1 according to another embodiment. As depicted, the waveform of Vrect is similar to Vrect in FIG. 3B, i.e., a dimmer is used to generate the waveform in FIGS. 4E and 4F. The timing sequences in FIGS. 4E and 4F are similar to those in FIGS. 4A and 4B, respectively, i.e., only one sensor amplifier is turned on at each point in time (FIG. 4E), or more than one sensor amplifier may be turned on at each point in time (FIG. 4F). It is noted that, in FIG. 4E, Tab 2 switch, such as SA2, is turned on at P2. However, as Vrect rises from the ground level at Pd, the current will begin to flow through the second current regulating circuit at Pd, i.e., the current will not flow between P2 and Pd. Also, there will be no current flowing through the LED groups between P1 and P2, even though SA1 is in the active state. As such, the total light emitted by the LED groups will be diminished as intended by the dimmer designer. Likewise, as depicted in FIG. 4F, both Tab 1 switch and Tab 2 switch are in the active state at Pd. However, as Vrect rises from the ground level at Pd, no current flows through the LED groups between P1 and Pd, to thereby reducing the total light emitted by the LED groups.

It is noted that the two types of signal sequencing modes (or, equivalently, phase control modes) in FIGS. 4A-4F may be applied to the driver 10. Likewise, these two types of sequencing modes can be applied to all of the driver circuits described in conjunction with FIGS. 5-9.

Figure 5:
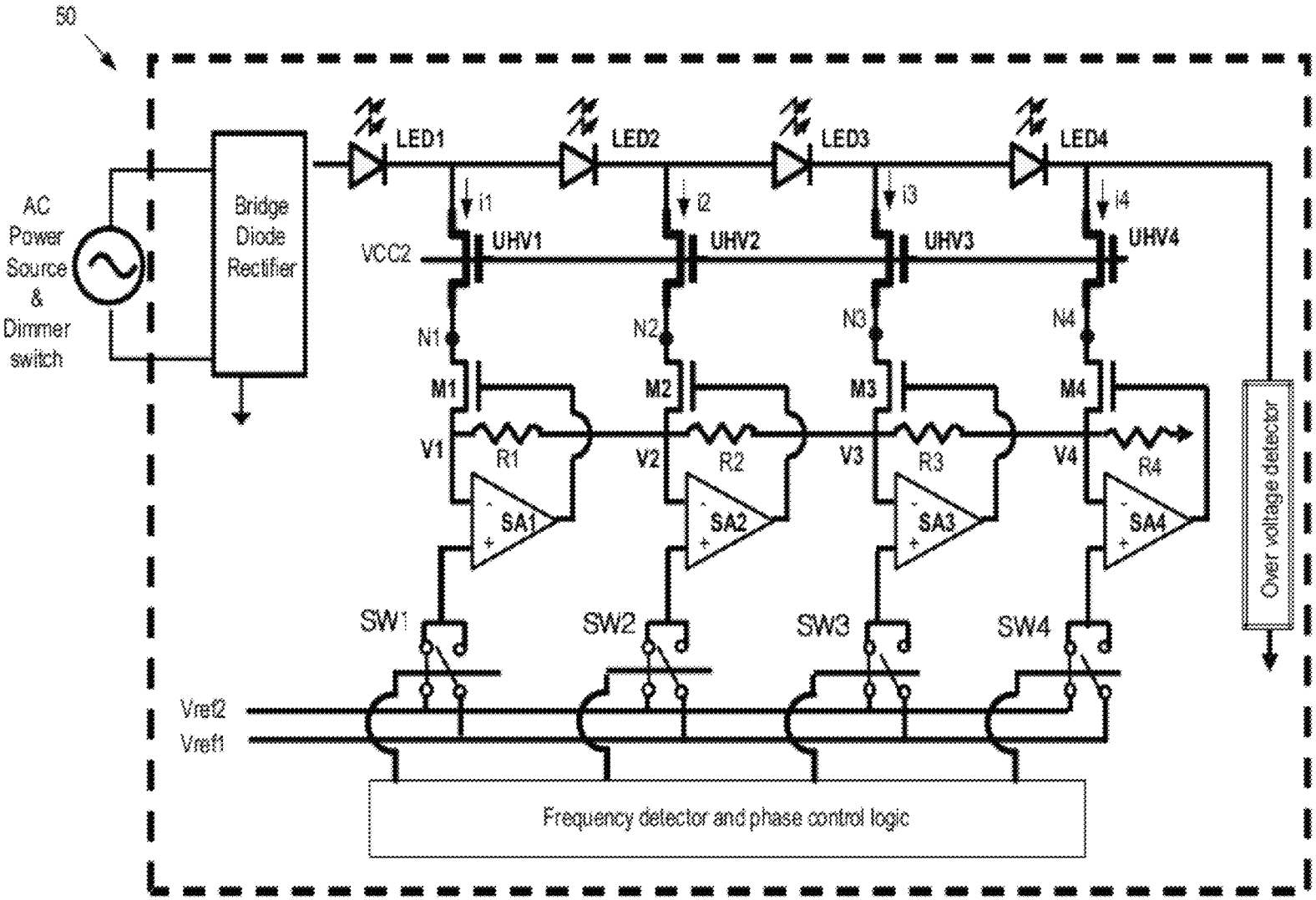
FIG. 5 shows a schematic diagram of an LED driver circuit in accordance with another embodiment of the present invention.

FIG. 5 shows a schematic diagram of an LED driver circuit 50 in accordance with another embodiment of the present invention. As depicted, the driver circuit 50 is similar to the driver circuit 10, the difference being that the phase-control-logic sends tab switch signals to the switches SW1-SW4, where each of the switches is connected to the corresponding sensor amplifier. For the purpose of illustration, assume that Vref2 is higher than Vref1. When each of the switches, say SW1, receives a turn-on signal from the phase-control-logic, it switches from Vref1 to Vref2. Then, the sensor amplifier, say SA1, compares Vref2 with V1, and sends an output signal to the regulating transistor, say M1, to thereby turn on the regulating transistor M1. Likewise, when SW1 receives a turn-off signal from the phase-control-logic, it switches from Vref2 to Vref1 and subsequently, the sensor amplifier SA1 may turn off the regulating transistor M1. Same analogy would be applied to other sensor amplifiers.

Figure 6:
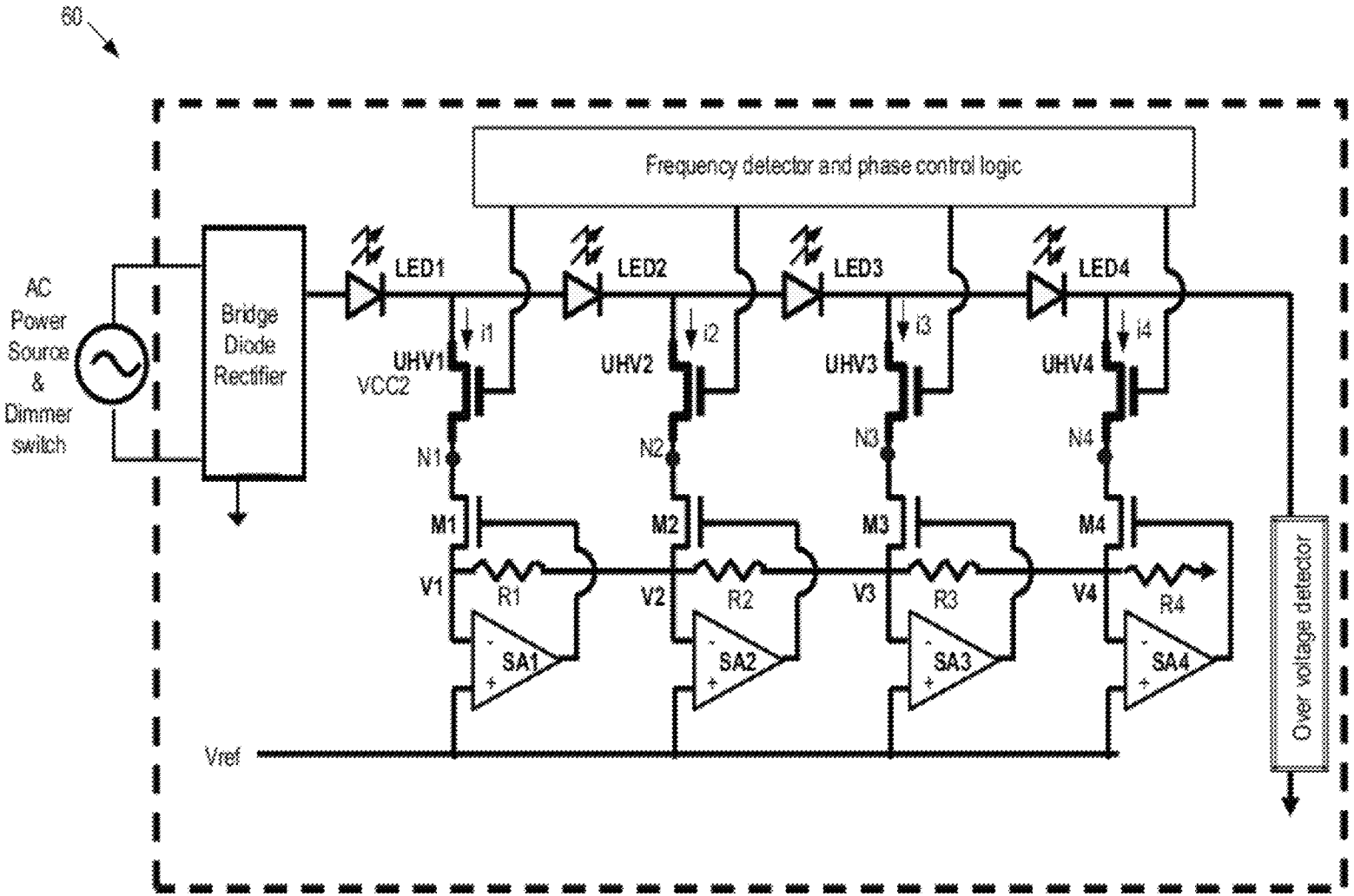
FIG. 6 shows a schematic diagram of an LED driver circuit in accordance with another embodiment of the present invention.

FIG. 6 shows a schematic diagram of an LED driver circuit 60 in accordance with another embodiment of the present invention. As depicted, the driver circuit 60 is similar to the driver circuit 10, the difference being that the phase-control-logic sends tab switch signals to the gates of the shielding transistors UHV1-UHV4. Thus, only one of the four shielding transistors UHV1-UHV4 may be turned on at each point in time if the phase-control-logic sends tab switch signals according to the phase control mode in FIG. 4A. However, more than one of the four shielding transistors UHV1-UHV4 may be turned on at a point in time if the phase-control-logic sends tab switch signals according to the phase control mode in FIG. 4B.

Figure 7:
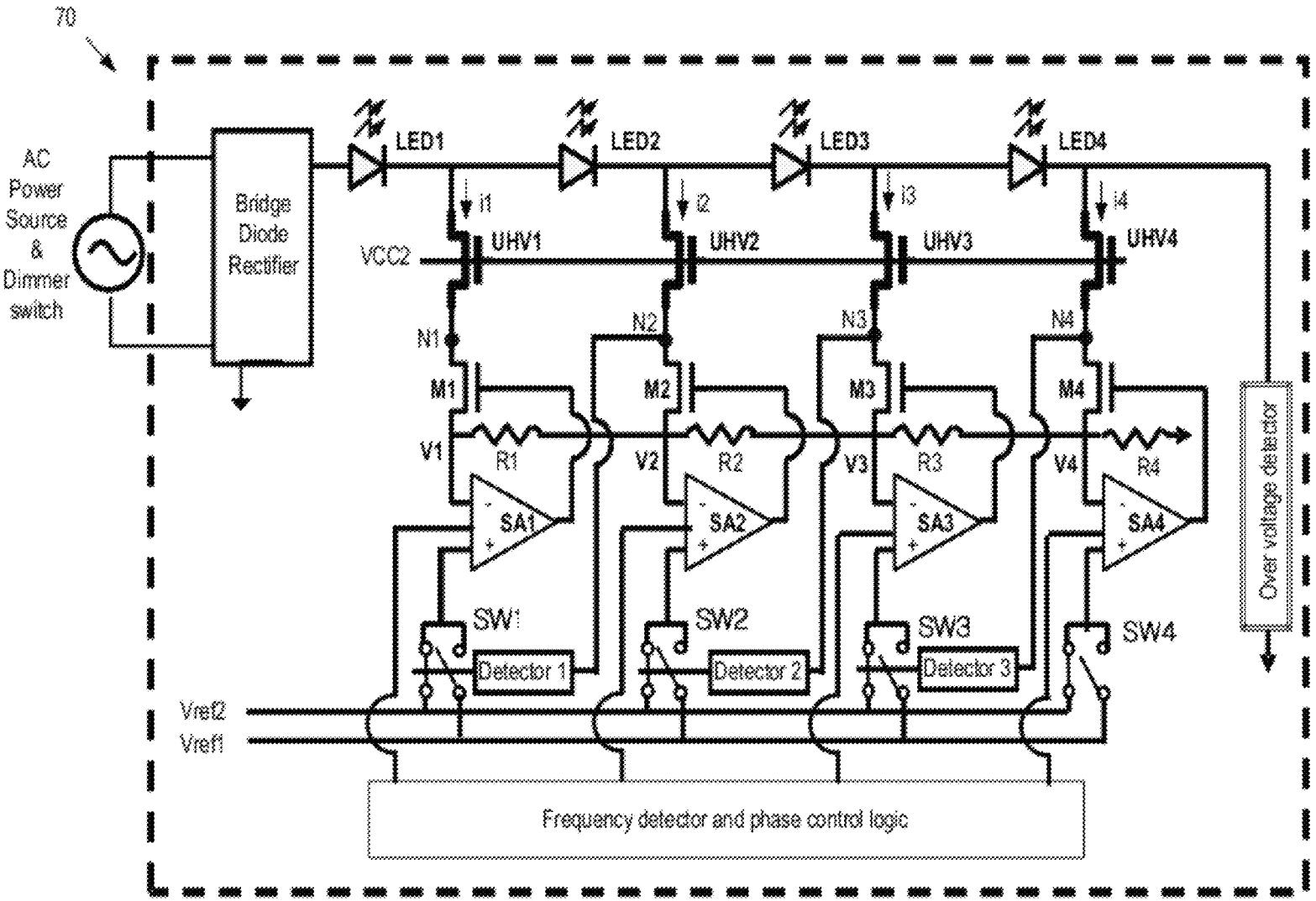
FIG. 7 shows a schematic diagram of an LED driver circuit in accordance with another embodiment of the present invention.

FIG. 7 shows a schematic diagram of an LED driver circuit 70 in accordance with another embodiment of the present invention. As depicted, the driver circuit 70 is similar to the driver circuit 10, the differences being that a switch is connected to each sensor amplifier and that a detector, say detector 1, may detect the voltage level at the node N2 and sends a signal to a switch upstream of the node, say SW1, so that the upstream switch selects one of the two reference voltages, Vref1 and Vref2.

Figure 8:
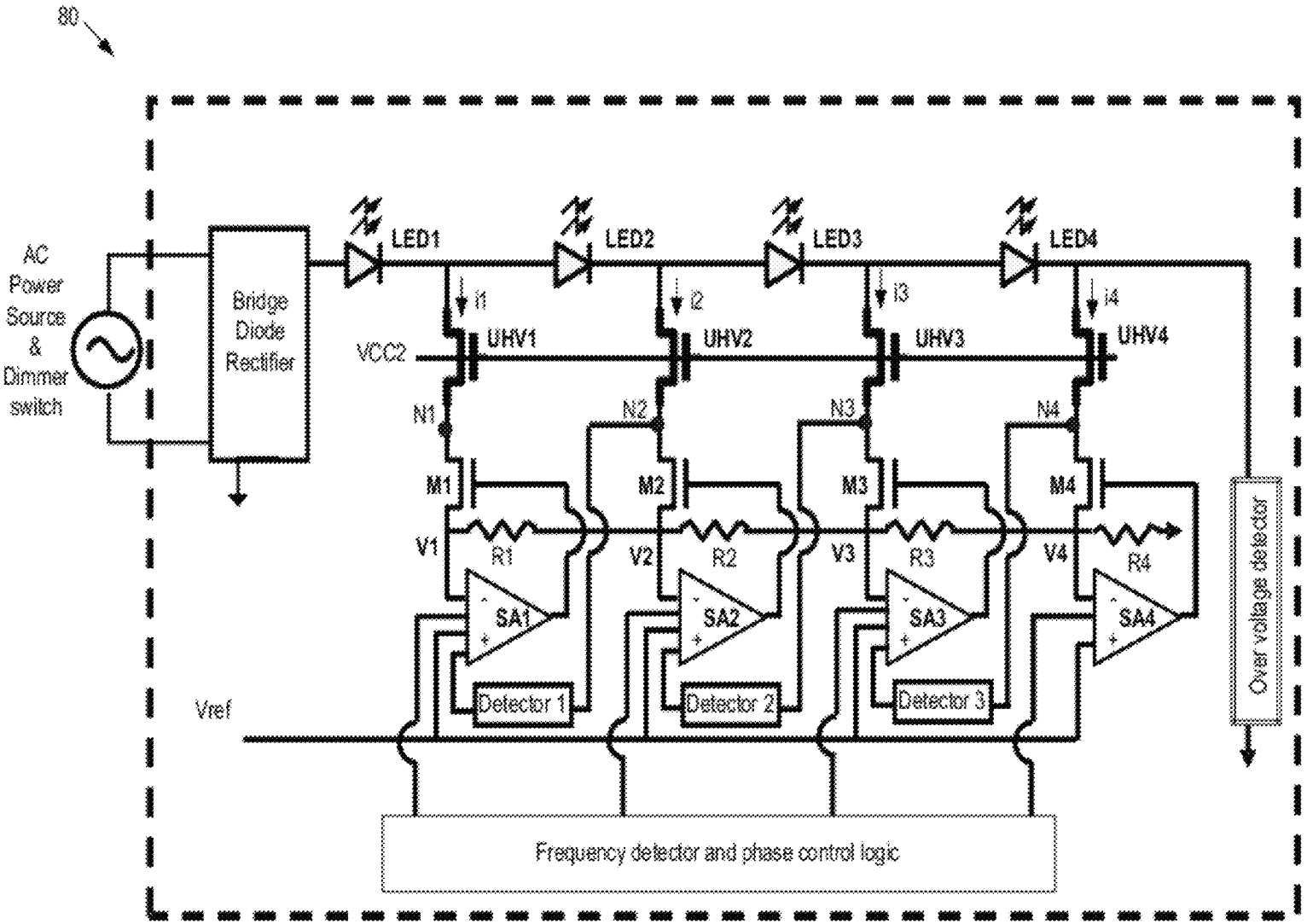
FIG. 8 shows a schematic diagram of an LED driver circuit in accordance with another embodiment of the present invention.

FIG. 8 shows a schematic diagram of an LED driver circuit 80 in accordance with another embodiment of the present invention. As depicted, the driver circuit 80 is similar to the driver circuit 10, the difference being that a detector, say detector 1, may detect the voltage level at the node N2 and sends a signal to a sensor amplifier upstream of the node, say SA1, so that the upstream sensor amplifier controls the corresponding regulating transistor, say M1.

Figure 9:
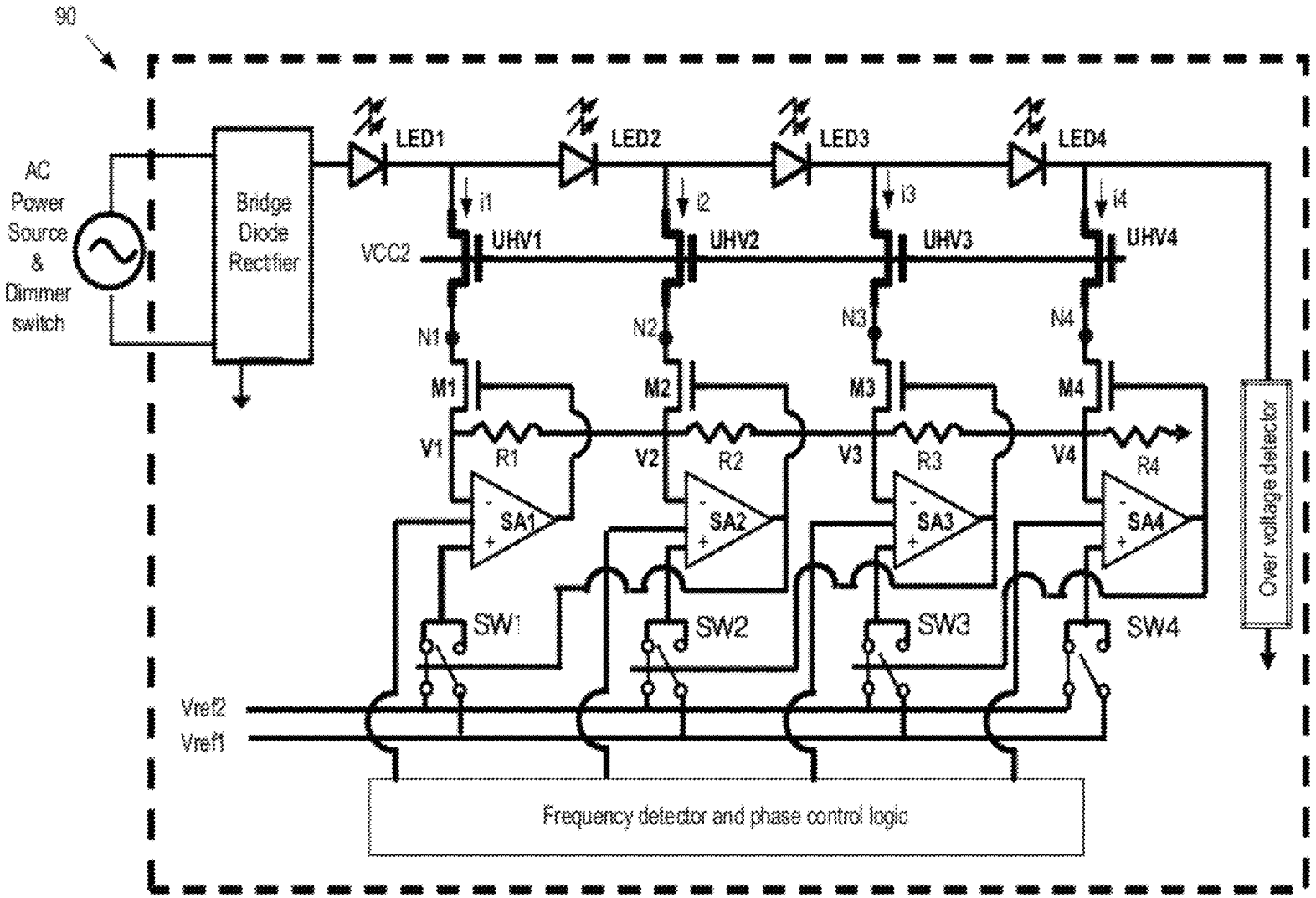
FIG. 9 shows a schematic diagram of an LED driver circuit in accordance with another embodiment of the present invention.

FIG. 9 shows a schematic diagram of an LED driver circuit 90 in accordance with another embodiment of the present invention. As depicted, the driver circuit 90 is similar to the driver circuit 70, the difference being that the output signal of a sensor amplifier, say SA2, is used to control the switch upstream of the sensor amplifier, say SW1. The output signal from the switch is input to the corresponding sensor amplifier to control the regulating transistor.

Figure 10:
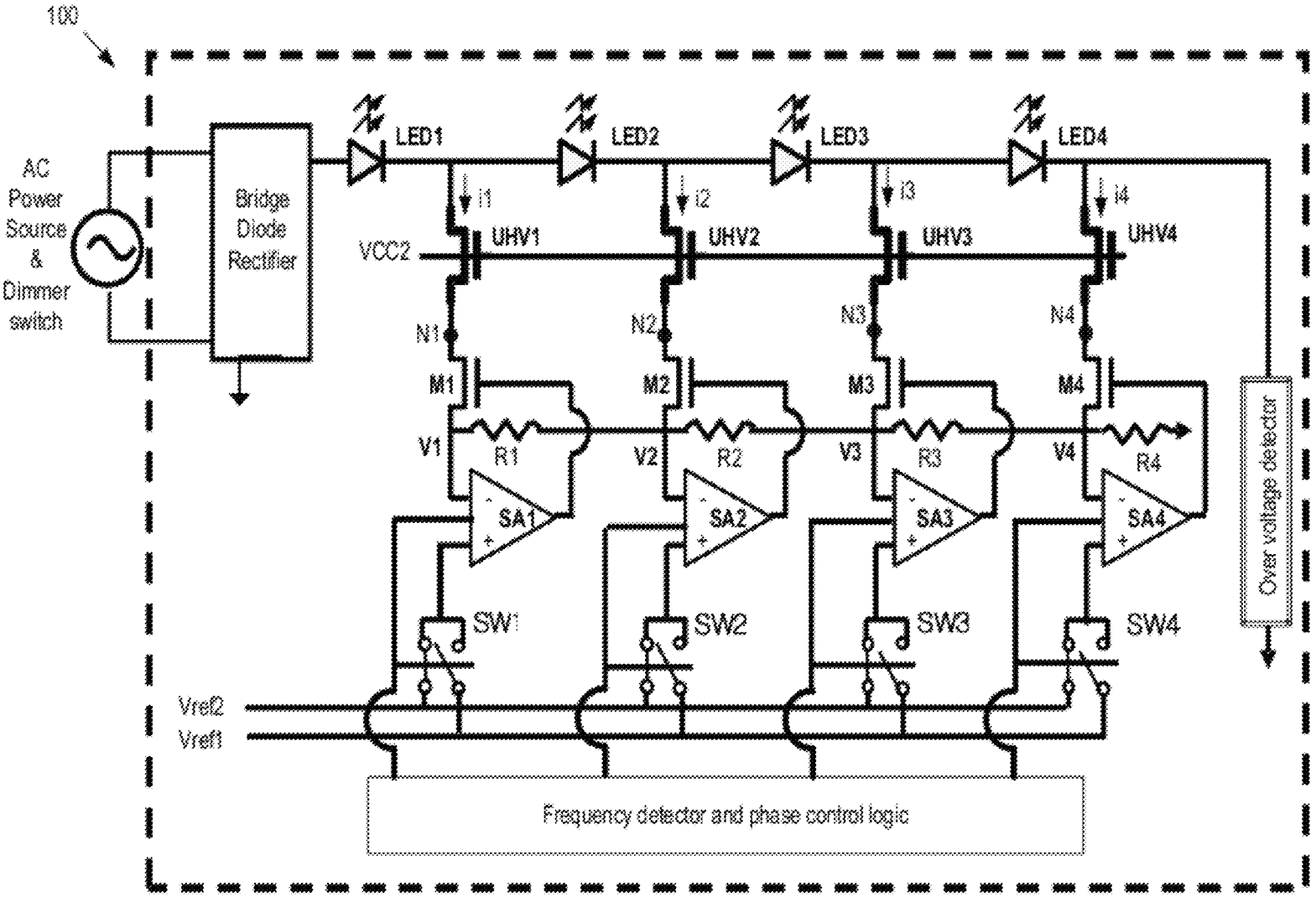
FIG. 10 shows a schematic diagram of an LED driver circuit in accordance with another embodiment of the present invention.

FIG. 10 shows a schematic diagram of an LED driver circuit 100 in accordance with another embodiment of the present invention. As depicted, the driver circuit 100 is similar to the driver circuit 50, the difference being that the phase-control-logic sends tab switch signals to the sensor amplifiers SA1-SA4 as well as the switches SW1-SW4. For the purpose of illustration, assume that the phase-control-logic sends a signal of FIG. 4A and Vref2 is higher than Vref1. At P1, SA1 will turn on M1 and at the same time, the switch SW1 will select Vref2. At P2, SA1 will turn off M1 and at the same time, the switch SW1 will switch from Vref2 to Vref1.

Figure 11A:
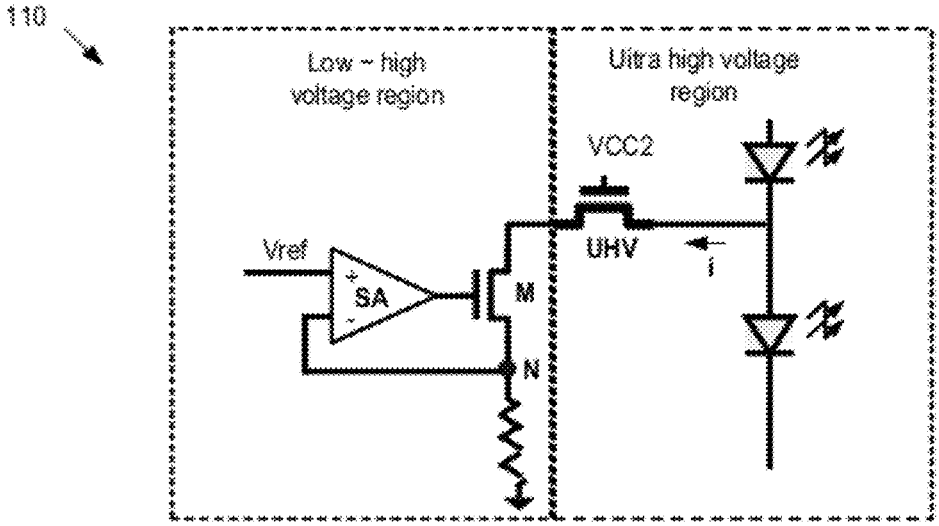
FIG. 11A-11C show schematic diagrams of circuits for controlling the current flowing through a transistor in accordance with another embodiment of the present invention.

FIG. 11A shows a schematic diagram of a circuit 110 for controlling the current i flowing through a regulating transistor M, where the circuit 110 may be included in the driver circuits 10 and 50~100. As depicted, the sensor amplifier SA compares the reference voltage Vref to the voltage level at the node N and sends an output signal to the gate of the regulating transistor M to thereby control the current i. The types and operational mechanisms of the components of the circuit 110 are described in conjunction with FIG. 1. For example, the regulating transistor M can be LV/MV/HV NMOS, while the shielding transistor can be UHV NMOS. For brevity, the description of other components is not repeated.

Figure 11B:
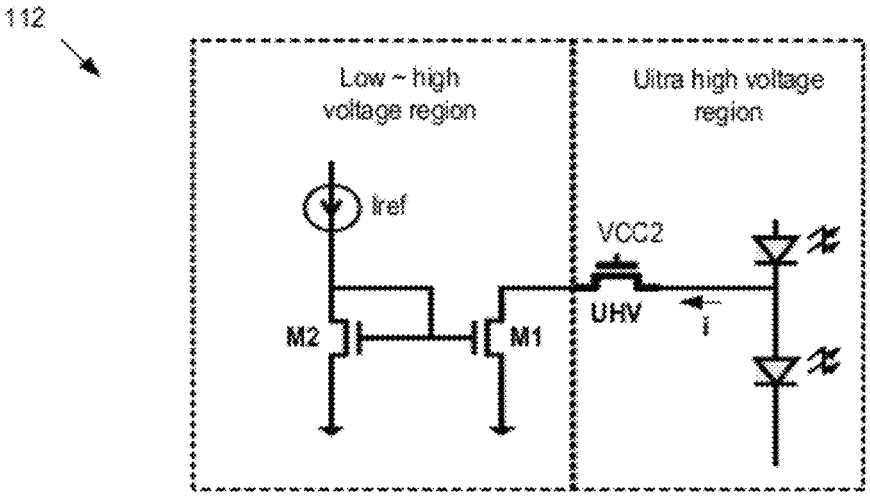

FIG. 11B shows a schematic diagram of a circuit 112 for controlling the current i flowing through a regulating transistor M1 in accordance with another embodiment of the present invention. As depicted, another transistor M2, which is identical to the regulating transistor M1, is connected to the regulating transistor M1 to form a current mirror configuration. More specifically, the gates of the two transistors M1, M2 are electrically connected to each other to have the same gate voltage. The current Iref flowing through the second transistor M2 is controlled to regulate the current i flowing through the regulating transistor M1. The current regulating circuit 112 may be used in place of the current regulating circuit 110 of FIG. 11A, and as such, the current regulating circuit 112 may be used in the driver circuits of FIGS. 1 and 5-10. Furthermore, the current Iref may be varied from one level to another to have the effect of switching the reference voltage from Vref1 to Vref2 (or, vice versa) in the driver circuits 50, 70, 90, and 100.

Figure 11C:
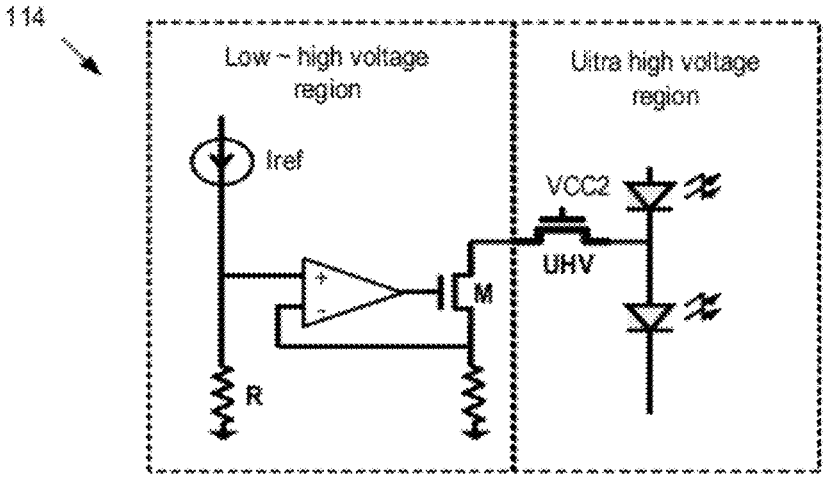

FIG. 11C shows a schematic diagram of a circuit 114 for controlling the current i flowing through a regulating transistor M in accordance with another embodiment of the present invention. As depicted, the sensor amplifier SA is provided with a non-inverting input voltage Vref, where Vref is determined by the equation:

$$V\text{ref}=I\text{ref}*R,$$

where Iref and R represent current and resistor, respectively.

The current regulating circuit 114 may be used in place of the current regulating circuit 110 of FIG. 11A. As such, the current regulating circuit 114 may be used in the driver circuits of FIGS. 1 and 5-10. Furthermore, the current Iref may be changed from one level to another to have the effect of switching the reference voltage from Vref1 to Vref2 (or, vice versa) in the driver circuits 50, 70, 90, and 100.

It is noted that only two reference voltages Vref1 and Vref2 are used for each switch of the driver circuits 50, 70, 90, and 100. However, it should be apparent to those of ordinary skill in the art that more than two references voltages may be used for each switch.

Figure 12:
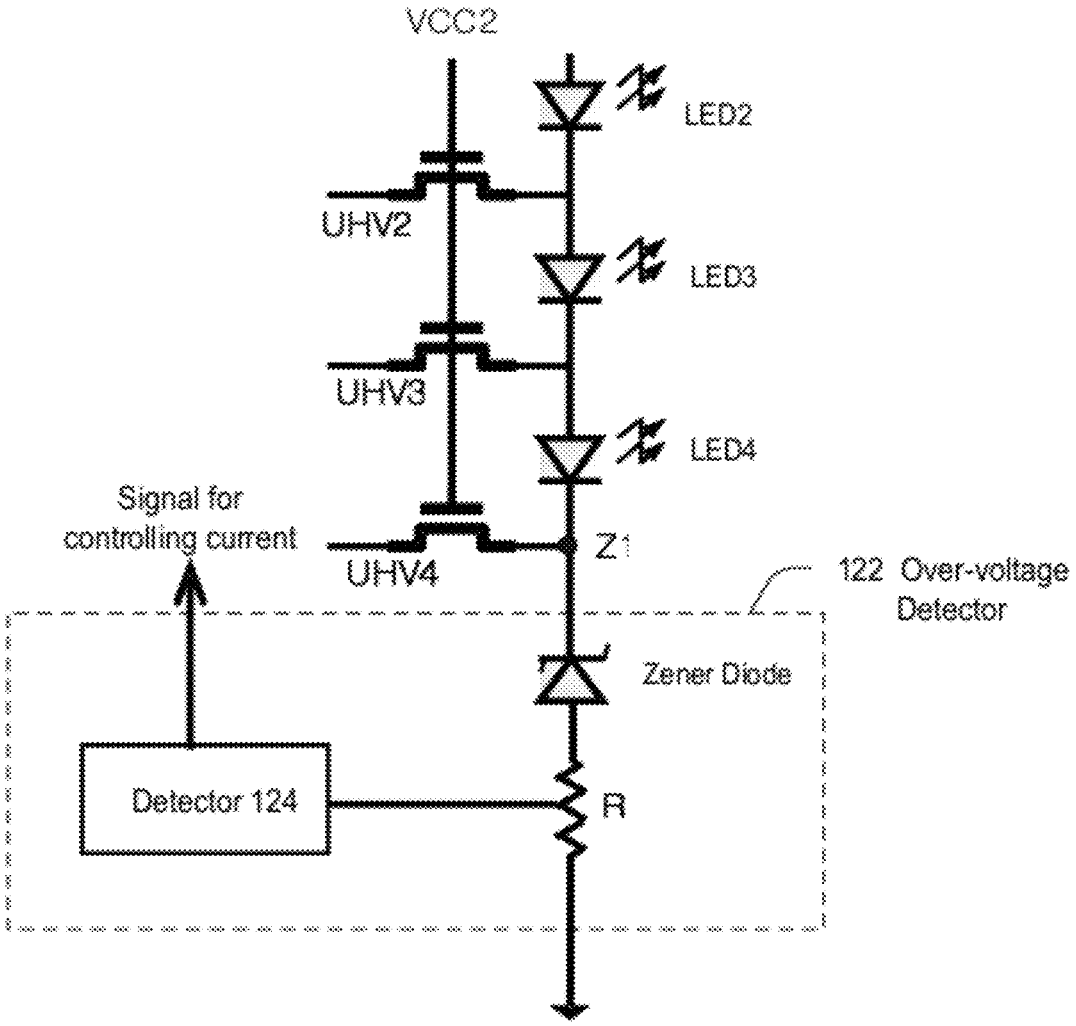
FIG. 12 shows a schematic diagram of an over-voltage detector in accordance with another embodiment of the present invention.

FIG. 12 shows a schematic diagram of an over-voltage detector 122 in accordance with another embodiment of the present invention. As depicted, the over-voltage detector 122 may include: a Zener diode connected to the downstream end of the last LED group; a detector 124 for detecting voltage; and a sensing resistor R. The voltage level at the node Z1 equals the voltage difference between Vrect and the voltage drop by the string of LEDs. When the voltage level at Z1 exceeds a preset level, which is preferably the breakdown voltage of the Zener diode, the current flows through the sensing resistor R. Then, a detector 124 detects the voltage level at a point of the resistor R and sends a signal to a proper component of the driver circuit to thereby control the current flowing through the LEDs, i.e., to cut off the current flowing through the LEDs or to prevent the excess power dissipation in the chip that contains the driver circuits. For example, the output signal of the over-voltage detector 122 is input to the SA4 in FIG. 1 so that the current i4 is cut off. In another example, the output signal is sent to a component (not shown in FIG. 1) that generates the reference voltage Vref so that the component may reduce the Vref in FIG. 1. In still another example, the output signal is used to lower the gate voltage Vcc2 of the shielding transistors UHVs. It is noted that the over-voltage detector 122 may be also used in the driver circuits of FIGS. 1 and 5-10.

Figure 13A:
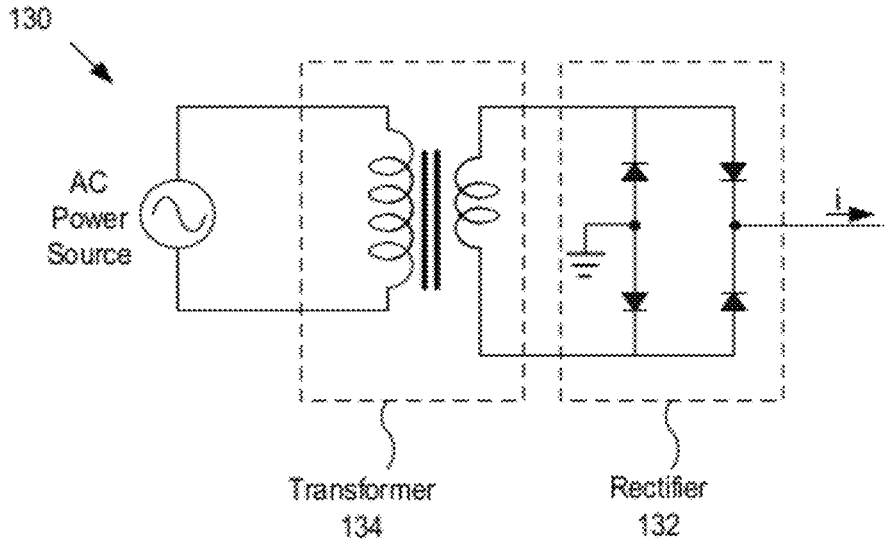
FIGS. 13A-13B show schematic diagrams of input power generators in accordance with another embodiment of the present invention.
Figure 13B:
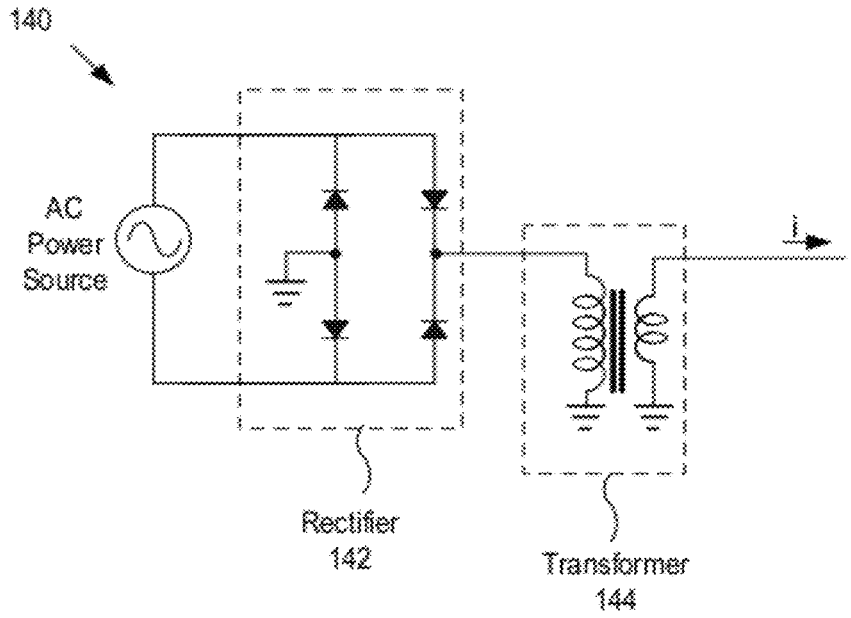

As depicted in FIGS. 1, and 5-10, each driver may include a rectifier to rectify the current supplied by an AC power source. In certain applications, such as high power LED street lights, the LEDs may demand high power consumption. In such applications, the driver may be isolated from the AC power source by a transformer for safety purposes. FIGS. 13A-13B show schematic diagrams of input power generators 130 and 140 in accordance with another embodiment of the present invention. As depicted in FIG. 13A, a transformer 134 may be disposed between AC input and the rectifier 132. Alternatively, a rectifier 142 may be disposed between AC input source and the transformer 144, as depicted in FIG. 13B. In both cases, the current i flows through one or more of the LED groups during operation. The input power generators 130 and 140 may be applied to the drivers of FIGS. 1, 5-10.

It should be understood, of course, that the foregoing relates to exemplary embodiments of the invention and that modifications may be made without departing from the spirit and scope of the invention as set forth in the following claims.

What is claimed is:

1. A method for driving light emitting diodes (LEDs), comprising:

providing a string of LEDs divided into groups, the groups being electrically connected to each other in series;

providing a power source electrically connected to the string of LEDs;

coupling each of the groups to a ground through a corresponding one of current regulating circuits, each of the current regulating circuits having a sensor amplifier and a cascode structure having first and second transistors;

applying a gate voltage to a gate of the first transistor;

applying a reference voltage to the sensor amplifier;

causing the sensor amplifier to send an output signal to a gate of the second transistor to thereby regulate a current flowing through the second transistor;

measuring a phase of a voltage waveform of the power source; and turning on the groups in a downstream sequence based on the measured phase.

2. A method as recited in claim 1, further comprising:

providing a dimmer switch; and causing the dimmer switch to process the voltage waveform to thereby adjust a luminance of the string of the LEDs.

3. A method as recited in claim 1, wherein the step of turning on the groups includes:

connecting a phase control logic directly to the gate of the first transistor; and causing the phase control logic to send an output signal to the gate of the first transistor.

4. A method as recited in claim 1, wherein the step of applying a gate voltage to a gate of the first transistor includes:

maintaining the gate voltage applied to the gate of the first transistor at a substantially constant level.

5. A method as recited in claim 1, wherein the step of turning on the groups includes:

connecting a phase control logic directly to the sensor amplifier; and causing the phase control logic to send a signal to the sensor amplifier when a difference between the phase of the voltage waveform and a reference phase matches a preset phase difference.

6. A method as recited in claim 5, further comprising, prior to the step of applying a reference voltage to the sensor amplifier:

causing a detector to detect a source voltage of the first transistor of a downstream group; and selecting, based on an output signal of the detector, one of the first and second substantially constant voltages as the reference voltage of the sensor amplifier of a next group upstream of the downstream group.

7. A method as recited in claim 5, further comprising:

causing a detector to detect a source voltage of the first transistor of a downstream group; and causing a detector to directly send a signal to the sensor amplifier of a next group upstream of the downstream group.

8. A method as recited in claim 5, further comprising, prior to the step of applying a reference voltage to the sensor amplifier:

selecting, based on an output signal of the sensor amplifier of a downstream group, one of the first and second substantially constant voltages as the reference voltage of the sensor amplifier of a next group upstream of the downstream group.

9. A method as recited in claim 1, further comprising, prior to the step of applying a reference voltage to the sensor amplifier:

causing a phase control logic to send a signal; and selecting, based on the signal received from the phase control logic, one of the first and second substantially constant voltages as the reference voltage of the sensor amplifier.

10. A method as recited in claim 1, further comprising, prior to the step of applying a reference voltage to the sensor amplifier:

causing a phase control logic to send a signal to the sensor amplifier; and selecting, based on the signal sent by the phase control logic, one of the first and second substantially constant voltages as the reference voltage of the sensor amplifier.

11. A method as recited in claim 1, further comprising, prior to the step of inputting a reference voltage:

causing a reference current to flow through a resistor; and taking a voltage difference across the resistor as the reference voltage.

12. A method as recited in claim 1, further comprising:

disposing a Zener diode and a resistor in series between a downstream end of the string of LEDs and the ground;

causing a detector to monitor a voltage level at a point of the resistor;

causing the detector to send a signal when a current flows though the Zener diode; and controlling, based on the output signal of the detector, a current flowing through the string of LEDs.

13. A method as recited in claim 12, wherein the step of controlling a current includes:

causing the sensor amplifier to receive the signal from the detector; and causing the sensor amplifier to send a signal to the gate of the second transistor.

14. A method as recited in claim 12, further comprising, prior to the step of applying a reference voltage to the sensor amplifier:

changing the reference voltage based on the signal from the detector.

15. A method as recited in claim 12, wherein the step of controlling a current includes:

changing the gate voltage of the first transistor by use of the signal from the detector.

16. A method as recited in claim 1, wherein at least one of the current regulating circuits includes a third transistor identical to the second transistor and the gate of the second transistor is directly connected to a gate of the third transistor to thereby form a current mirror, further comprising:

regulating a current flowing through the second transistor by varying a current flowing through the third transistor.

17. A driver circuit for driving light emitting diodes (LEDs), comprising:

a string of LEDs divided into n groups, the n groups of LEDs being electrically connected to each other in series, a downstream end of group m−1 being electrically connected to the upstream end of group m, where m being a positive number equal to or less than n, an upstream end of group 1 being configured to couple to a power source operative to provide an input voltage;

a plurality of current regulating circuits, each of the current regulating circuits being coupled to the downstream end of a corresponding group at one end and coupled to a ground at an other end and having a sensor amplifier and a cascode having first and second transistors; and a phase control logic for sending a signal to each of the current regulating circuits to thereby control a current flow through each of the current regulating circuits.

18. A driver as recited in claim 17, wherein each of the groups includes one or more LEDS and resistors of the same or different kind, color, and value, connected in parallel or in series or combination thereof.

19. A driver as recited in claim 17, wherein the first transistor is an ultra-high-voltage (UHV) transistor and is a N-Channel MOSFET, a P-Channel MOSFET, a NPN bipolar transistor, a PNP bipolar transistor, or an Insulated gate bipolar Transistor (IGBT).

20. A driver as recited in claim 17, wherein the second transistor is a low-voltage, a medium voltage, or a high voltage transistor and is a N-Channel MOSFET, a P-Channel MOSFET, a NPN bipolar transistor, a PNP bipolar transistor, or an Insulated gate bipolar Transistor (IGBT).

21. A driver as recited in claim 17, wherein the phase control logic includes:

a frequency selector for determining a frequency of the input voltage and assigning a preset time interval to each of the current regulating circuits; and a selector for selecting a particular one of the current regulating circuits and sending a signal to the particular current regulating circuit when a phase of the input voltage matches the preset time interval.

22. A driver as recited in claim 17, wherein the phase control logic is directly connected to a gate of the first transistor.

23. A driver as recited in claim 17, wherein the phase control logic is directly connected to the sensor amplifier.

24. A driver as recited in claim 23, further comprising:

a plurality of switches, each of the switches being connected to the sensor amplifier of the corresponding current regulating circuit and adapted to switch between two reference voltages.

25. A driver as recited in claim 24, further comprising:

a detector for detecting a source voltage of the first transistor of the current regulating circuit corresponding to group m and sending a signal to the switch corresponding to group m−1.

26. A driver as recited in claim 24, wherein an output pin of the sensor amplifier of the current regulating circuit corresponding to group m is connected to the switch corresponding to group m−1.

27. A driver as recited in claim 23, further comprising a detector for detecting a source voltage of the first transistor of the current regulating circuit corresponding to group m and sending a signal to the sensor amplifier of the current regulating circuit corresponding to group m−1.

28. A driver as recited in claim 17, further comprising:

a plurality of switches, each of the switches being connected to the sensor amplifier of the corresponding current regulating circuit and adapted to switch between two reference voltages using the signal sent by the phase control logic.

29. A driver as recited in claim 28, wherein the phase control logic is directly connected to the sensor amplifier.

30. A driver as recited in claim 17, wherein the sensor amplifier of each of the current regulating circuits is connected to a voltage source for providing a reference voltage thereto and the voltage source includes a reference current source and a resistor.

31. A driver as recited in claim 17, wherein each of the current regulating circuits includes a third transistor identical to the second transistor and a gate of the third transistor is directly connected to a gate of the second transistor to form a current mirror.

32. A driver as recited in claim 17, further comprising:

an over-voltage detector connected to a downstream end of the string of LEDs.

33. A driver as recited in claim 32, wherein the over-voltage detector includes a Zener diode, a resistor, and a detector adapted to detect a voltage at a point in the resistor.

34. A driver as recited in claim 17, further comprising:

a plurality of resistors, each of the resistors being disposed between a source of the second transistor of a corresponding group and the ground.

35. A driver as recited in claim 17, further comprising:

a dimmer switch for controlling a waveform of the input voltage.

36. A driver as recited in claim 17, further comprising a rectifier and a transformer.

* * * * *